US006168293B1

(12) United States Patent
Lieszkovszky et al.

(10) Patent No.: US 6,168,293 B1
(45) Date of Patent: Jan. 2, 2001

(54) SPOT PAR REFLECTOR LAMP

(75) Inventors: Laszlo Viktor Lieszkovszky, Mayfield Heights; Ludwig Skilskyj, Concord; Edward Joseph Collins, Painesville; Jacob Brann, Cleveland, all of OH (US)

(73) Assignee: General Electric Company, Schenectady, NY (US)

( * ) Notice: Under 35 U.S.C. 154(b), the term of this patent shall be extended for 0 days.

(21) Appl. No.: 09/370,832

(22) Filed: Aug. 9, 1999

(51) Int. Cl.[7] ..... F21V 7/00

(52) U.S. Cl. ..... 362/297; 362/304; 362/305; 362/348; 362/302; 362/347

(58) Field of Search ..... 362/304, 305, 362/302, 348, 347, 297

(56) References Cited

U.S. PATENT DOCUMENTS 4,021,659 * 5/1977 Wiley ..... 362/297
4,277,821 * 7/1981 Sassmannshausen ..... 362/346
4,420,800 * 12/1983 Van Horn ..... 362/297
4,447,865 * 5/1984 VanHorn et al. ..... 362/305
4,494,176 * 1/1985 Sands et al. ..... 362/297
4,506,316 * 3/1985 Thiry et al. ..... 362/309
4,959,583 * 9/1990 Arsena et al. ..... 313/113
5,177,396 * 1/1993 Gielen et al. ..... 313/113
5,199,787 * 4/1993 King et al. ..... 362/310

* cited by examiner

*Primary Examiner*—Thomas M. Sember
*Assistant Examiner*—Ali Alavi
(74) *Attorney, Agent, or Firm*—Fay, Sharpe, Fagan, Minnich & McKee, LLP

(57) ABSTRACT

A reflector lamp (10) has a forward parabolic section (58) and a rear concave section (60), which may be parabolic, ellipsoidal, or spherical. A light source (24), such as the filament of a halogen lamp, is axially aligned with the axis of the reflector (LA) and is centered at the focal point of the forward and rear sections. The parabolic forward section is fluted to spread the light reflected therefrom smoothly in a beam of light, minimizing the center hot spot. The rear section, which is not fluted, directs the light reflected therefrom within the desired beam angle, resulting in little wasted light being emitted outside the desired beam angle.

15 Claims, 6 Drawing Sheets

SPOT PAR REFLECTOR LAMP

BACKGROUND OF THE INVENTION

This invention relates to the lamp arts. More particularly, this invention relates to a reflector for use in reflector spot PAR reflector lamps and will be described with particular reference thereto. It should be appreciated that the invention is also applicable to reflective lamps employing a variety of light sources.

The reflector lamps of the present invention are particularly well suited for use in spot lighting, such as headlamps, display lighting, and the like. Examples of typical reflector lamps include General Electric's PAR 30, PAR 38, and PAR 64 lamps. PAR is the commonly accepted acronym for "parabolic aluminum reflector." Other commercially available reflector lamps may also benefit from aspects of the present invention. U.S. Pat. Nos. Re.30,832; 3,010,045; 4,021,659; 4,804,878; 4,833,576; 4,855,634; 4,959,583; and 5,199,878 describe reflector lamps and methods of their manufacture. U.S. Pat. No. 4,420,800 discloses reflectors with a combination of confocal spherical and parabolic shaped portions. U.S. Pat. No. 4,494,176 describes a PAR lamp with a faceted parabolic reflector surface. The filament is at the focal point of the parabolic portion but not of a small adjacent neck portion of the reflector resulting in wasted light due to reflections outside the beam angle. U.S. Pat. No. 5,199,787 describes a reflector lens with curved, radial flutes. FIG. 1 shows a conventional parabolic reflector A. FIG. 2 shows a fluted parabolic reflector B.

It has now been found that while flutes on the top of the reflector are useful in spreading filament image within the beam angle, flutes at the bottom (or neck area) of the reflector create an undesirably large spread.

For a good spot reflector lamp it is desirable to have as much light as possible emitted in a beam of 0–5° from the axis of the lamp. Light emitted in the 6–10° range is essentially wasted. However too much light in the center (approximately 0–1°) is also undesirable, leading to uneven light distribution and burn out.

The present invention provides for a new and improved reflector lamp, which overcomes the above-reference problems and others.

SUMMARY OF THE INVENTION

In accordance with one aspect of the present invention, a reflector lamp is provided. The lamp includes first and second reflective sections. The first reflective section has a generally parabolic shape and a focal point and having an axis passing through the focal point. A plurality of flutes occupying a major portion of the first reflective section. The second reflective section has a generally concave shape which is substantially free of flutes and a focal point which is substantially coincident with the focal point of the first reflective section. The second reflective section is joined to the first reflective section. A light source is approximately centered at the focal point of the first reflective section and the focal point of the second reflective section.

In accordance with another aspect of the present invention, a method of forming a beam of light in which a majority of the light is within a 6° angle from an axis through the beam and is substantially free of a central hot spot is provided. The method includes providing a light source at the focal point of first and second reflective surfaces. The first reflective surface has a plurality of flutes. The second reflective surface is free of flutes. The method further includes reflecting a first portion of light emitted from the light source from the first reflective surface, the flutes distributing the light to minimize the hot spot and reflecting a second portion of light emitted from the light source from the second reflective surface, the non-fluted second reflective surface reflecting the light primarily within the 6° angle from the axis through the beam.

One advantage of the present invention is that light is emitted within a desired beam angle of about 5 degrees.

Another advantage of the present invention is that a smooth beam is provided with a minimized hot spot effect.

Still further advantages of the present invention will become apparent to those of ordinary skill in the art upon reading and understanding the following detailed description of the preferred embodiments.

DETAILED DESCRIPTION OF THE INVENTION

Reference will now be made in detail to the present preferred embodiment of the invention, an example of which is illustrated by the accompanying drawings. While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Figure 3:
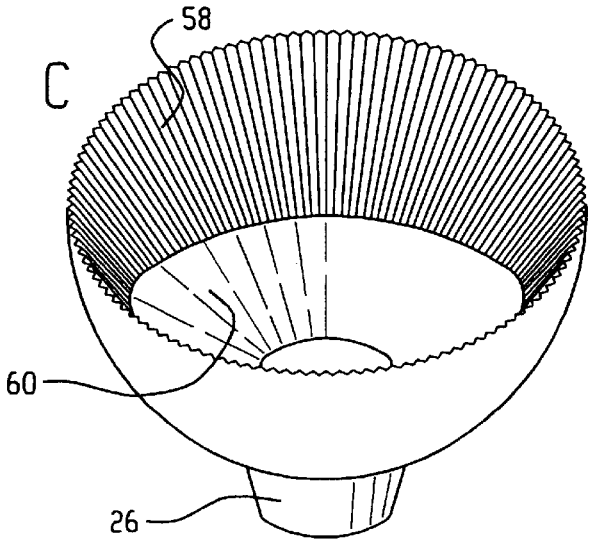
FIG. 3 is a perspective view of a reflector with a fluted parabolic section, according to the present invention.
Figure 4:
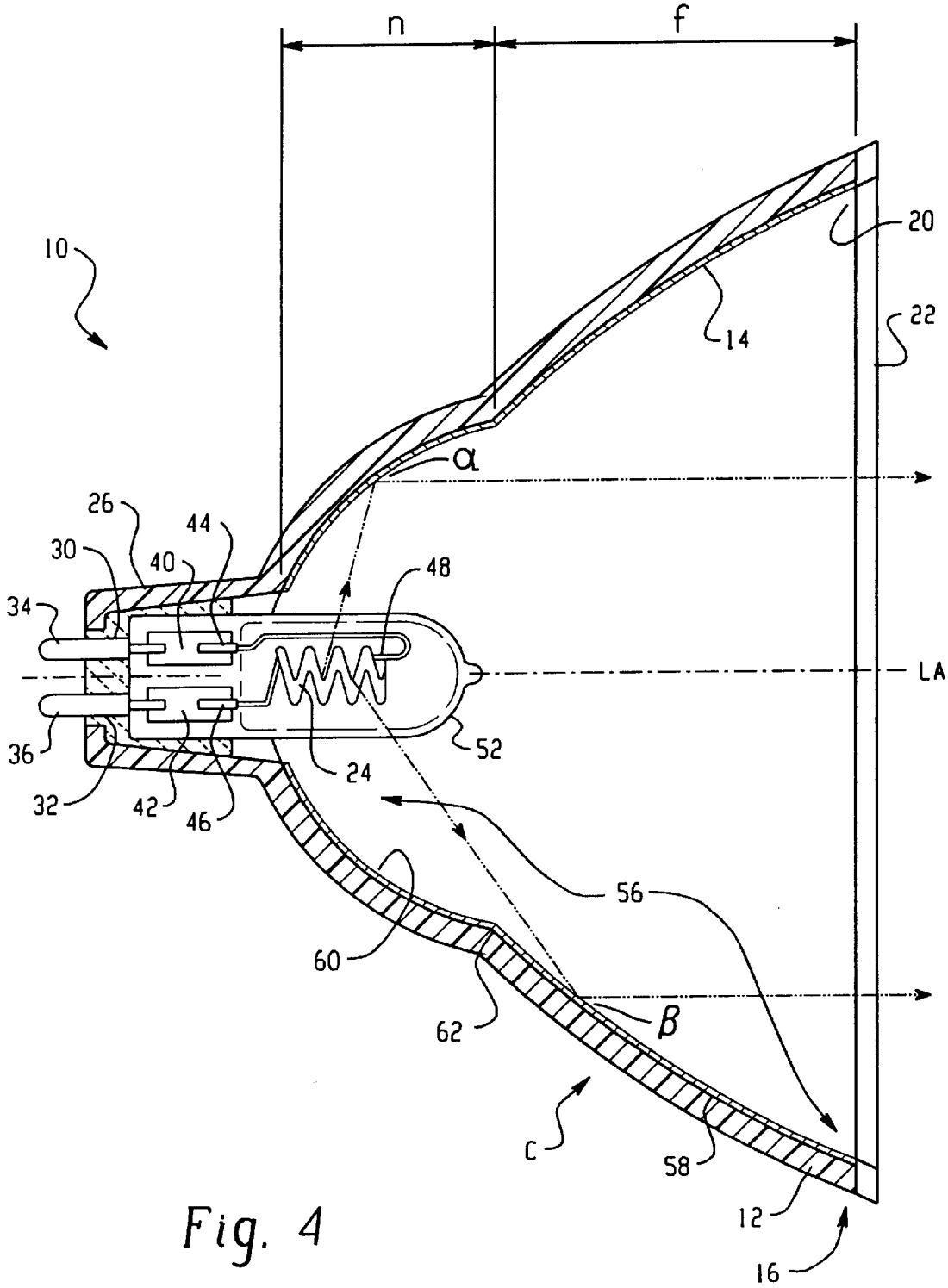
FIG. 4 is a side sectional view of a lamp incorporating the reflector of FIG. 3, showing light reflecting from fluted and non-fluted sections.

Referring now to FIGS. 3 and 4, a lamp 10 comprises a shaped reflector C comprising a housing 12 with an interior reflective coating 14 of silver, aluminum, or other suitable material so as to reflect light. The housing may be formed from molded or blown glass, plastic, or other suitable material.

The reflector housing 12 includes a first end or rim 16 defining an opening 20 at the front plane of the reflector housing. A lens 22 is mated to the rim. A light source 24, such as a filament, is positioned with its longest dimension along the axis of the lamp LA. Lens 22 may be transparent to all light, or may include a filter to absorb/reflect the light dispersed by the light source 24. In fact, lens 22 may be designed, as known in the art, to meet the particular requirements of the lamp.

A neck or second end 26 of reflector housing 12 includes two pass-through channels 30 and 32 which accommodate leads 34 and 36 for connecting the lamp to an external power supply (not shown). Leads 34 and 36 are in electrical connection with foils 40 and 42, which in turn are in electrical connection with leads 44 and 46. In this manner, electricity is provided to the light source 24. As shown in FIG. 4, a filament support 48 is electrically connected with the lead 44 and the filament 24 is electrically connected with the lead 46. If desired, an envelope 52 surrounds the light source. It will be appreciated that a variety of light sources may be used with the lamp, including incandescent, arc, halogen bulb, and others. As is apparent, the longitudinal axis LA of the filament 24 lies on the axis LA of the reflector housing 12.

The concave, coated, reflective portion 56 of the reflector housing 12 includes a forward section 58, adjacent the lens, and a rear section 60, connecting the forward section with the neck 26. The forward section 58 is parabolic in general configuration and is fluted on its internal surface. The rear section 60 is a smooth, reflective portion, and is preferably ellipsoid, although a spherical or parabolic section 60 may also be used. The forward and rear sections are connected at a circumferential region 62, which preferably provides a smooth transition between the forward and the rear sections (i.e. the tangent at the rear section adjacent the circumferential region is the same as the tangent at the adjacent forward section).

The filament 24 or other light source is neither infinite nor infinitesimal in size and is preferably centered at the focal point of both the parabolic, fluted section 58 and the ellipsoidal, spherical, or parabolic, non-fluted section 60. In this way, both the fluted section and the non-fluted section reflect light from the filament in a direction generally parallel with the axis of the lamp. The light passes through the lens and exits the lamp as a beam of light in which a large portion of the emitted light is within a beam angle of about 5°. The light is relatively uniform within the beam angle, without a significant hot spot in the center.

As shown in FIG. 4, the non-fluted section projects a distance n along the axis LA of the lamp from the neck and the fluted section 58 projects a distance f along the lamp axis from the non-fluted section to the lens. The image of the filament 24 is projected at a much larger angle ($\alpha$) from the non-fluted section 60, than from the fluted section 58 ($\beta$). As shown in FIG. 4, f is larger than n. The ratio of f:n is preferably from about 2:1.

Figure 5:
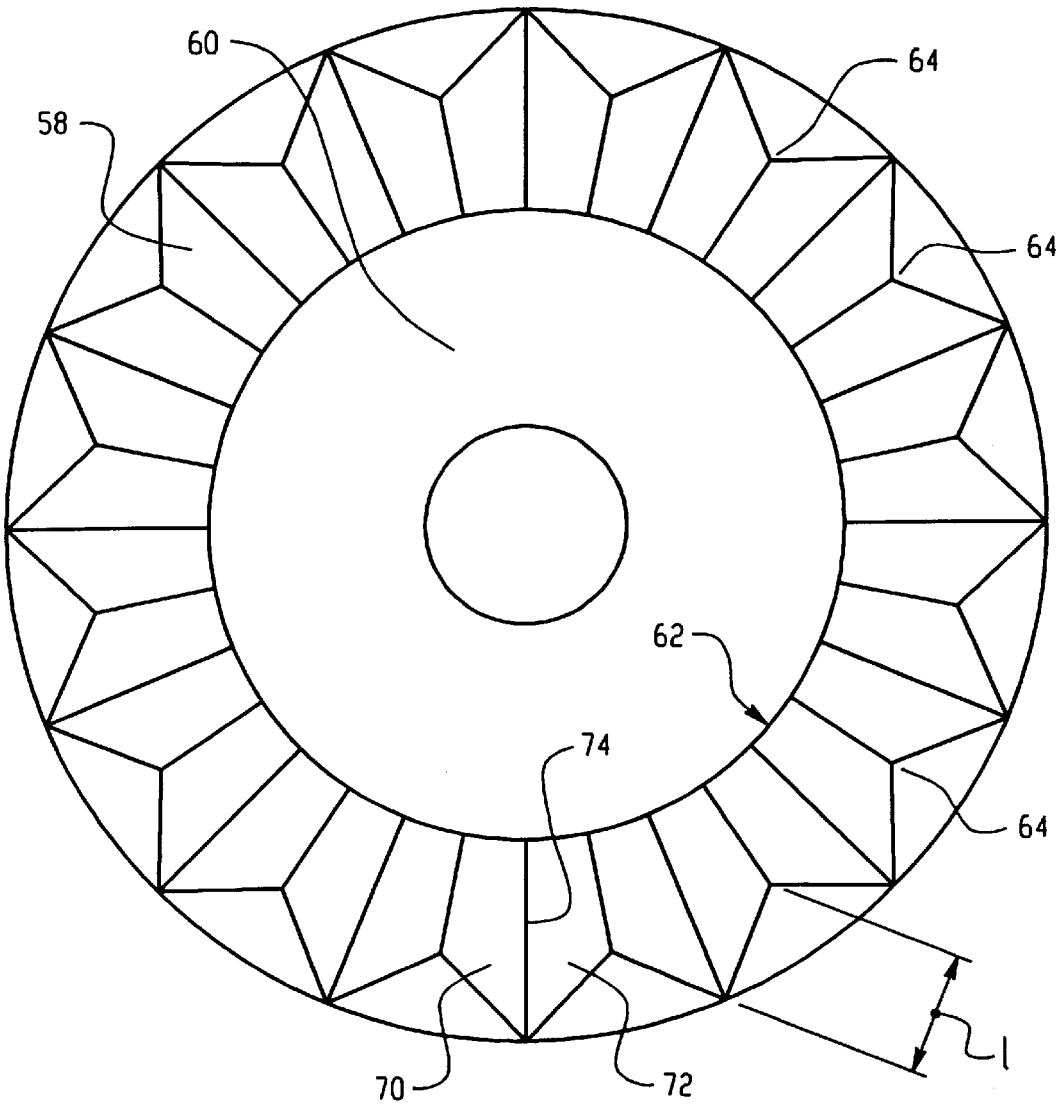
FIG. 5 is an enlarged front view of the reflector of FIG. 3, showing positioning of the flutes.

With reference also to FIG. 5, the fluted section 58 comprises a number of flutes 64, arranged around the interior surface of the fluted section. The flutes preferably cover all, or the majority of the interior surface of the fluted section. The flutes preferably are aligned with the axis LA, although they may be at a slight angle without unduly compromising the light output. For a reflector housing of 4½" (11–12 cm) diameter there are preferably between about 12 and 144 flutes 64, more preferably, 48–96 flutes, and most preferably, about 72 flutes. In a preferred embodiment, each flute comprises two generally planar faces 70, 72, which meet at an edge 74. The length l of one of the faces can be larger than that of the other face, if desired, such that the two faces reflect light at slightly different angles to improve evenness of the beam.

Figure 1:
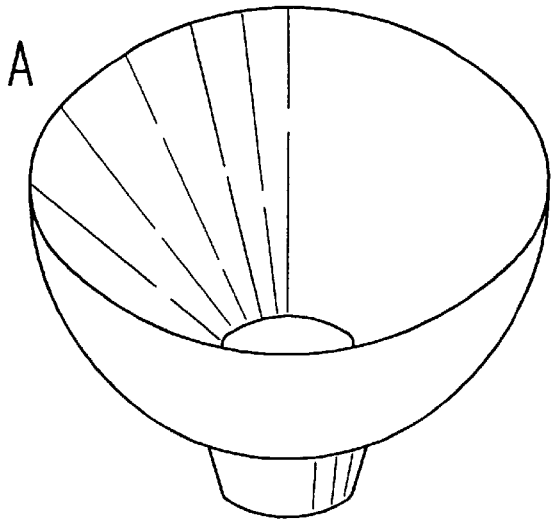
Fig. 1 (PRIOR ART)
FIG. 1 is a perspective view of a prior art parabolic reflector.
Figure 2:
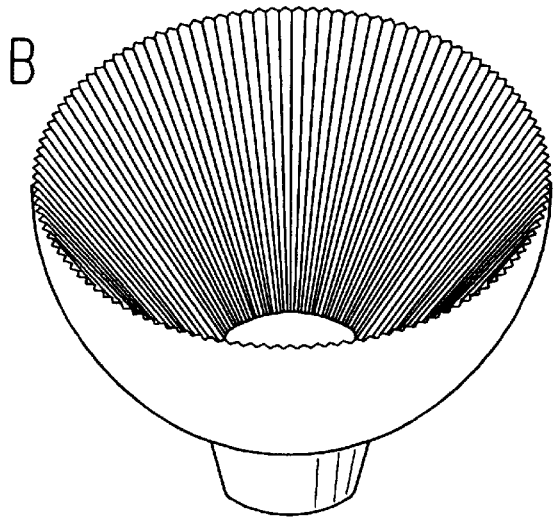
Fig. 2 (PRIOR ART)
FIG. 2 is a perspective view of a prior art parabolic reflector with flutes.
Figure 6:
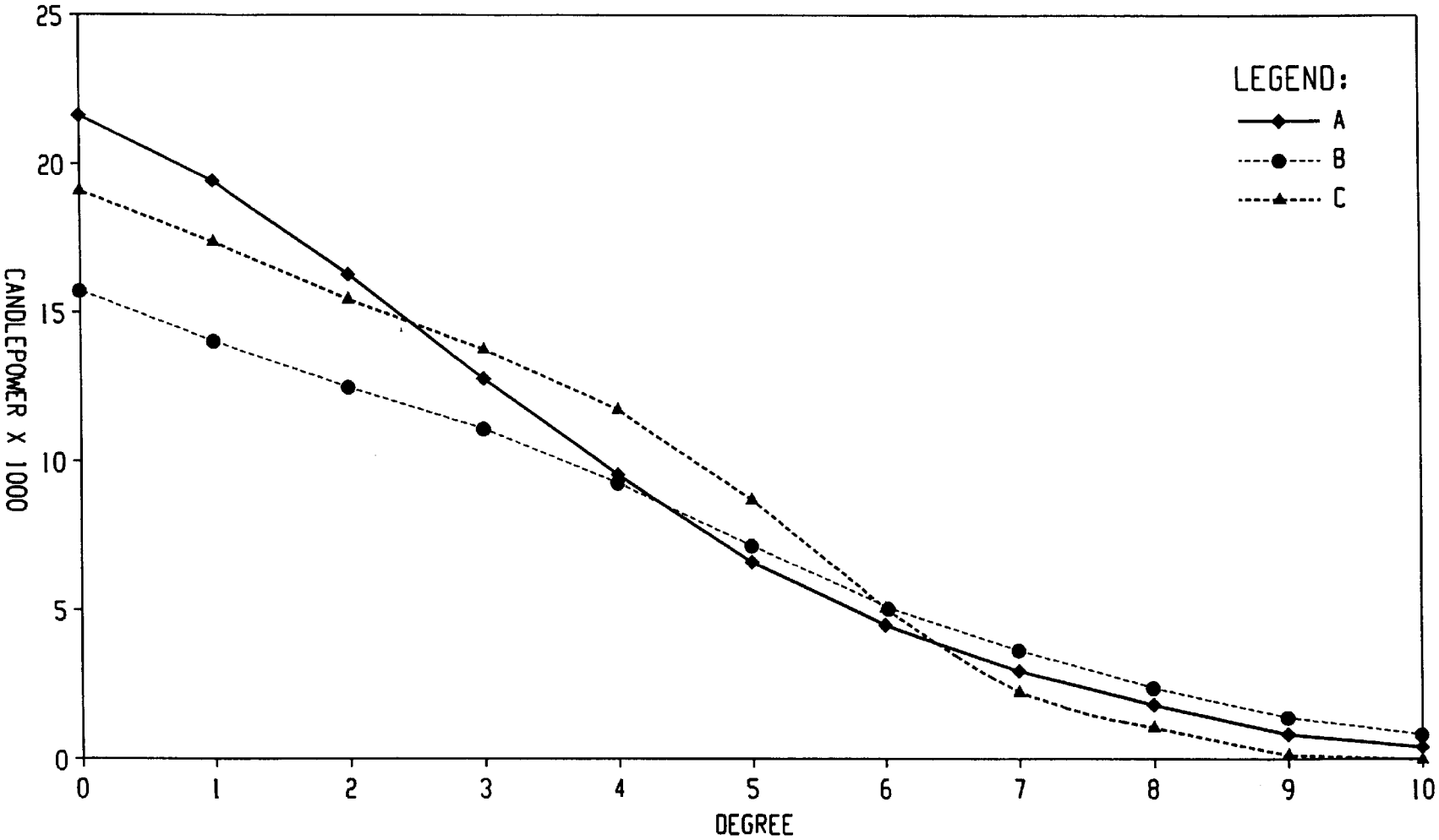
FIG. 6 is a plot of candlelight power against beam angle relative to the reflector axis (0° being the center, along the reflector axis)

With reference now to FIG. 6, a plot of luminous intensity vs. angle from the axis LA for three lamps using the reflectors A, B, C of FIGS. 1, 2, and 3 is shown. Reflector C had a paraboloidal rear section 60 and an f:n ratio of about 2:1, measured along the axis of the reflector. The plots for the three reflector shapes were calculated using a computer algorithm based on actual geometries. Data obtained from actual lamps was in agreement with the computer-generated curves.

As shown in FIG. 6, the candlepower distribution curve shows that A has a high value in the center, showing an undesirable hot spot. The intensity drops off rapidly in the desired beam angle range (0–6°, more preferably, about 0–5°) as shown by the steep slope of curve A. However, at large angles (above about 7°) the luminous intensity is still significant. This light is essentially wasted as it misses the target.

For reflector B, the hot spot effect is less than for reflector A, but the amount of wasted light directed at large angles is even greater, resulting from the negative effect of fluting close to the neck.

In the optimized embodiment of reflector C, the undesirable hot spot effect is minimized and the luminous intensity aimed at the target (between 0–5°) is maximized. The wasted luminous intensity (between about 6 and 10°) is minimized. The beneficial effects of reflector C are even more pronounced if measured by luminous flux.

Figure 7:
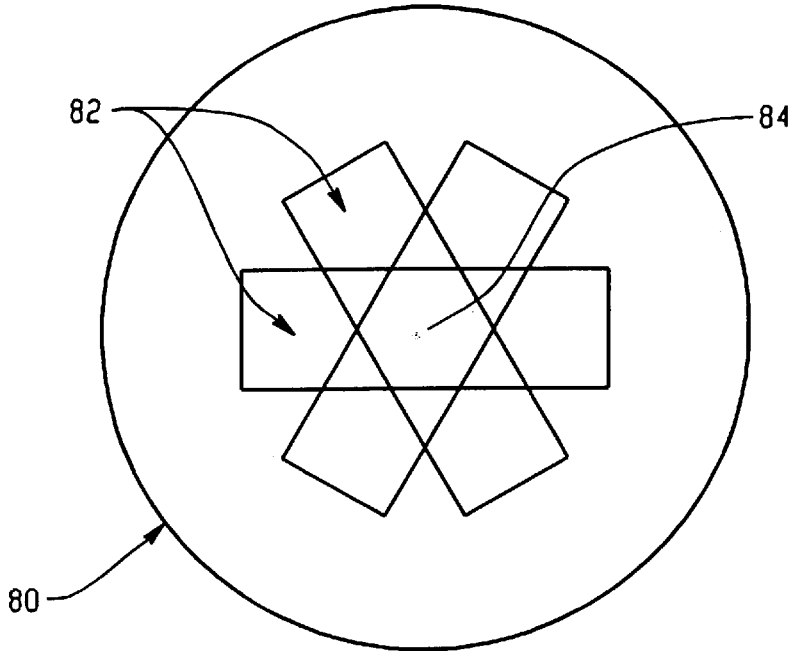
FIG. 7 is a schematic view of a target illuminated by light reflecting from a non-fluted forward section of the reflector housing of FIG. 1.
Figure 8:
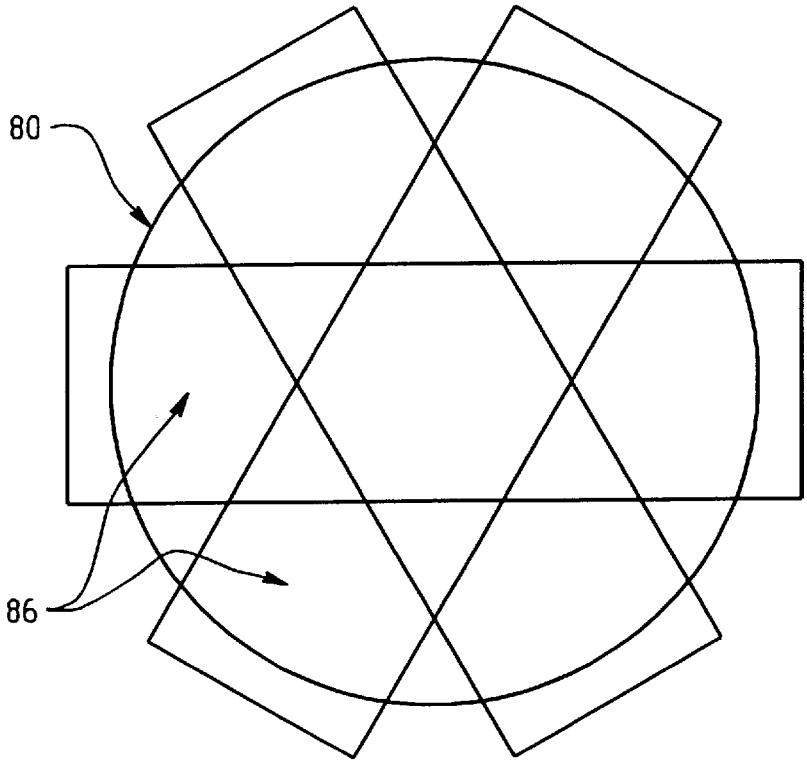
FIG. 8 is a schematic view of a target illuminated by light reflecting from a non-fluted rear section of the reflector housing of FIG. 1.
Figure 9:
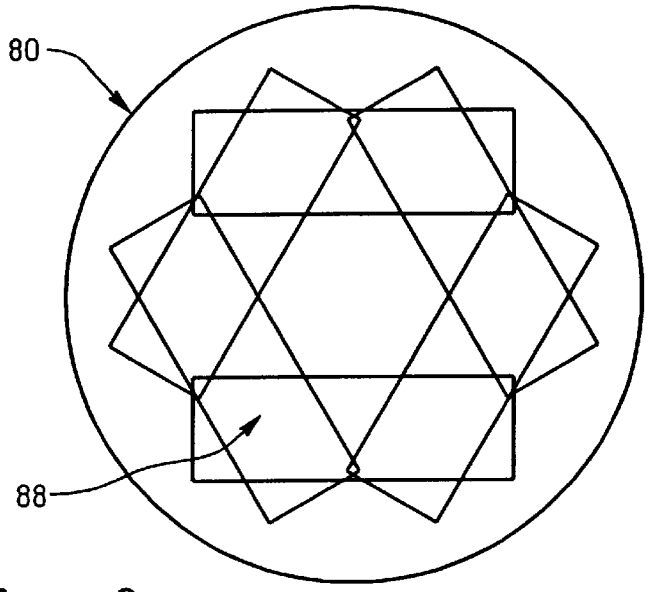
FIG. 9 is a schematic view of a target illuminated by light reflecting from a fluted forward section of the reflector housing of FIG. 3.
Figure 10:
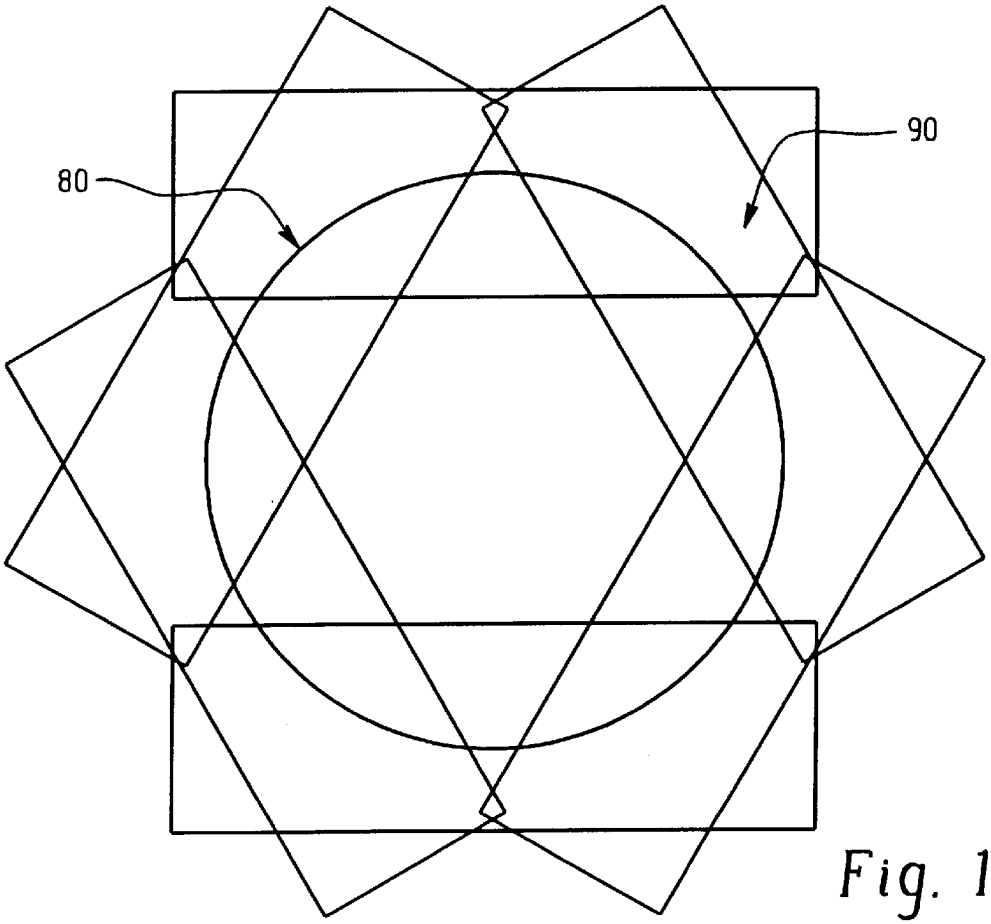
FIG. 10 is a schematic view of a target illuminated by light reflecting from a fluted rear section of the reflector housing of FIG. 2.

With reference to FIGS. 7–10, theoretical projected images of the filament versus a target illumination area 80 are shown for various lamp designs to show the benefits of a fluted forward section 58. Images 82 from section 58 of the reflector, if it were not fluted, would overlap as shown in FIG. 7, causing a hot spot 84 in the middle. Conversely, images 86 from the section 60 closer to the filament 24, partially fall outside the target, as shown in FIG. 8. Fluting of section 58 results in a more even distribution of the filament images 88, resulting in more uniform illumination, as shown in FIG. 9. However, fluting of section 60 causes more light to fall outside the target area, as shown in FIG. 10, since the filament images 90 are deflected even further away from the center, as compared with FIG. 8. The optimum combination for minimizing wasted light and providing uniform illumination is achieved by combining the a non fluted rear section 60 (FIG. 8) and a fluted forward section 58 (FIG. 9).

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A reflector lamp comprising:

a first reflective section having a generally parabolic shape and a focal point and having an axis passing through the focal point, a plurality of flutes occupying a major portion of the first reflective section;

a second reflective section having a concave shape which is free of flutes and a focal point which is coincident with the focal point of the focal point of the first reflective section, said second reflective section being joined to said first reflective section;

a light source axially aligned relative to the axis of the first reflective section and approximately centered at the focal point of the first reflective section and the focal point of the second reflective section, the second reflective surface reflecting the light primarily within a 6° angle from a central axis of a beam of light emitted from the reflector lamp.

2. The lamp of claim 1, wherein the light source is axially aligned relative to the axis of the first reflective section.

3. The lamp of claim 1, further including a lens located at an open end of the first reflective section.

4. The lamp of claim 1, wherein the first reflective section projects a distance f along the axis and the second reflective section extends a distance n along the axis and wherein a ratio f:n is about 2:1.

5. The lamp of claim 1, wherein there are from 12 to 144 flutes.

6. The lamp of claim 1, wherein there are from 48–96 flutes.

7. The lamp of claim 6, wherein there are about 72 flutes.

8. A reflector lamp comprising:

a first reflective section having a generally parabolic shape and a focal point and having an axis passing through the focal point, a plurality of flutes occupying a major portion of the first reflective section;

a second reflective section having a concave shape which is free of flutes, said second reflective section being joined to said first reflective section at a circumferential region;

a light source axially aligned relative to the axis of the first reflective section and approximately centered at the focal point of the first reflective section and the focal point of the second reflective section, wherein a tangent at the second reflective section adjacent the circumferential region is the same as a tangent at the first reflective section adjacent the circumferential region such that there is a smooth transition region between the first and second reflective sections.

9. The lamp of claim 1, wherein the second reflective section is one of parabolic, spherical, and ellipsoidal.

10. The lamp of claim 9, wherein the second reflective section is ellipsoidal.

11. The lamp of claim 1, wherein the light source is selected from the group consisting of halogen, discharge, and semiconductor light sources.

12. A method of forming a beam of light in which a majority of the light is within a 6° angle from a longitudinal axis through the beam and the beam is substantially free of a central hot spot, the method comprising:

providing a light source at the focal point of first and second reflective surfaces, the first reflective surface having a plurality of flutes, the second reflective surface being free of flutes;

reflecting a first portion of light emitted from the first reflective surface, the flutes distributing the light to minimize the hot spot;

reflecting a second portion of light emitted from the light source from the second reflective surface, the non-fluted second reflective surface reflecting the light primarily within the 6° angle from the axis through the beam.

13. The method of claim 12, wherein the first portion of light is of greater luminous intensity than the second portion of light.

14. A reflector lamp comprising:

a generally parabolic reflective portion including:

a first reflective section having a focal point and having an axis passing through the focal point, a plurality of flutes occupying a major portion of the first reflective section;

a second reflective section which is free of flutes, said second reflective section being joined to said first reflective section;

a light source axially aligned relative to the axis of the first reflective section and approximately centered at the focal point of the first reflective section and the focal point of the second reflective section.

15. The lamp of claim 14, wherein the first reflective section projects a distance f along the axis and the second reflective section extends a distance n along the axis and wherein a ratio f:n is about 2:1.

* * * * *